United States Patent [19]

Walker

[11] Patent Number: 4,519,136

[45] Date of Patent: May 28, 1985

[54] SHELLFISH CUTTING AND EATING IMPLEMENT

[76] Inventor: Ernest D. Walker, 2116 Falling Creek Rd., Silver Spring, Md. 20904

[21] Appl. No.: 583,870

[22] Filed: Feb. 27, 1984

[51] Int. Cl.[3] ..... A22C 29/02; B26B 13/22

[52] U.S. Cl. ..... 30/142; 30/146; 17/68; 17/71

[58] Field of Search ..... 17/66, 68, 75, 71; 30/142, 137, 146, 148, 257; 7/134, 131

[56] References Cited

U.S. PATENT DOCUMENTS

| | | | |
|---|---|---|---|
| 133,267 | 11/1872 | Starin | 17/75 |
| 159,598 | 2/1875 | Megee | 7/134 X |
| D. 196,381 | 9/1963 | Basilotta | 17/75 X |
| 1,219,857 | 3/1917 | Parkhurst | 17/71 |
| 1,230,766 | 6/1917 | Ovens | 30/142 |
| 1,232,682 | 7/1917 | Hartleb | 30/148 X |
| 2,560,673 | 7/1951 | Vosen et al. | 30/257 |
| 2,600,013 | 6/1952 | Malone | 30/137 |
| 2,785,436 | 3/1957 | Noland et al. | 17/68 |
| 3,846,908 | 11/1974 | Allievi | 17/75 X |
| 4,103,395 | 8/1978 | Latorella | 17/71 |

FOREIGN PATENT DOCUMENTS

| | | | |
|---|---|---|---|
| 25386 | 12/1883 | Fed. Rep. of Germany . | |
| 12242 | 8/1910 | France | 30/137 |

*Primary Examiner*—Jimmy C. Peters

*Attorney, Agent, or Firm*—Donald A. Kettlestrings

[57] ABSTRACT

A shellfish cutting and eating implement having first and second lever members pivotally connected together. The first lever member includes a first elongated handle portion and a first elongated jaw portion defining a first cutting edge, a first substantially flat side surface and a flared end. The second lever member includes a second elongated handle portion and a second elongated jaw portion defining a second notched cutting edge. The flared end of the first lever member is substantially flat and perpendicular to the first flat side surface to help keep the first jaw portion in the proper position during the cutting operation. The flared end also defines a pointed forward end, in the shape of a fork, to facilitate spearing and removal of the shellfish meat.

8 Claims, 7 Drawing Figures

SHELLFISH CUTTING AND EATING IMPLEMENT

This invention relates to a hand operated implement, and more particularly to a shellfish cutting and eating implement.

Cleaning and eating shellfish, such as lobster or crabs, can be a time consuming, difficult and messy procedure. Typically, a hammer or mallet is used for cracking the shell. The shell is then removed in pieces to expose the meat. This process often results in trauma to the hands from the sharp edges and projections of the shell. Protective clothing, such as a bib or apron, is usually necessary to avoid soiling underlying clothing.

It is, therefore, an object of the present invention to provide a shellfish cutting and eating implement.

Another object is to provide such an implement which quickly and cleanly cuts through the shell of shellfish to expose the meat inside.

A further object of the invention is the provision of such an implement which can be used for removing the meat from the shellfish.

Additional objects and advantages of the invention will be set forth in part in the description which follows, and in part will be obvious from the description or may be learned by practice of the invention. The objects and advantages are realized and attained by means of the instrumentalities and combinations particularly pointed out in the appended claims.

To achieve these and other objects the present invention provides a shellfish cutting and eating implement comprising a first lever member including a first elongated handle portion, a first elongated jaw portion defining a first cutting edge and having a flared end, a first substantially flat side surface, and a first intermediate portion. A second lever member is provided and includes a second elongated handle portion, a second elongated jaw portion defining a second notched cutting edge, and a second intermediate portion. Means are provided in operative relationship with the first and second intermediate portions for pivotally connecting together the first and second lever members and the flared end is substantially flat and substantially perpendicular to the first flat side surface and the flared end defines a pointed forward end.

In accordance with the invention, the first cutting edge is preferably continuous, and the notches in the second jaw portion are V-shaped and substantially evenly spaced along the second cutting edge to form a plurality of cutting edge portions separated by the notches. The total combined length of the cutting edge portions is preferably substantially equal to the total combined length of the spaces between the cutting edge portions formed by the notches to providean optimum cutting-crushing capability.

The accompanying drawings, which are incorporated in and constitute a part of this specification, illustrate an example of a preferred embodiment of the invention and, together with the description, serve to explain the principles of the invention.

Figure 1:
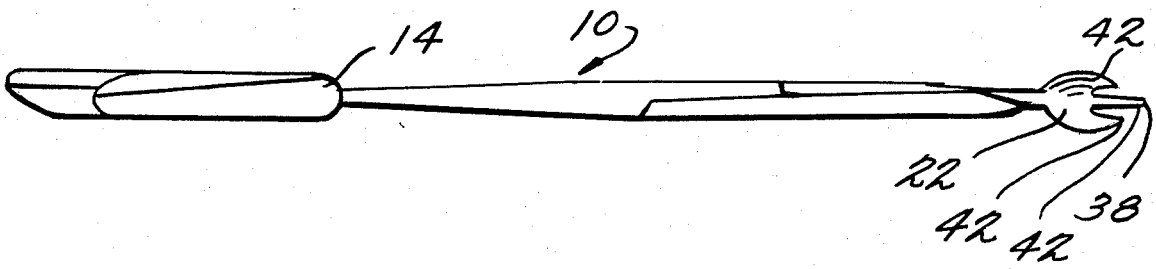
FIG. 1 is a top plan view of the implement in a closed position.
Figure 2:
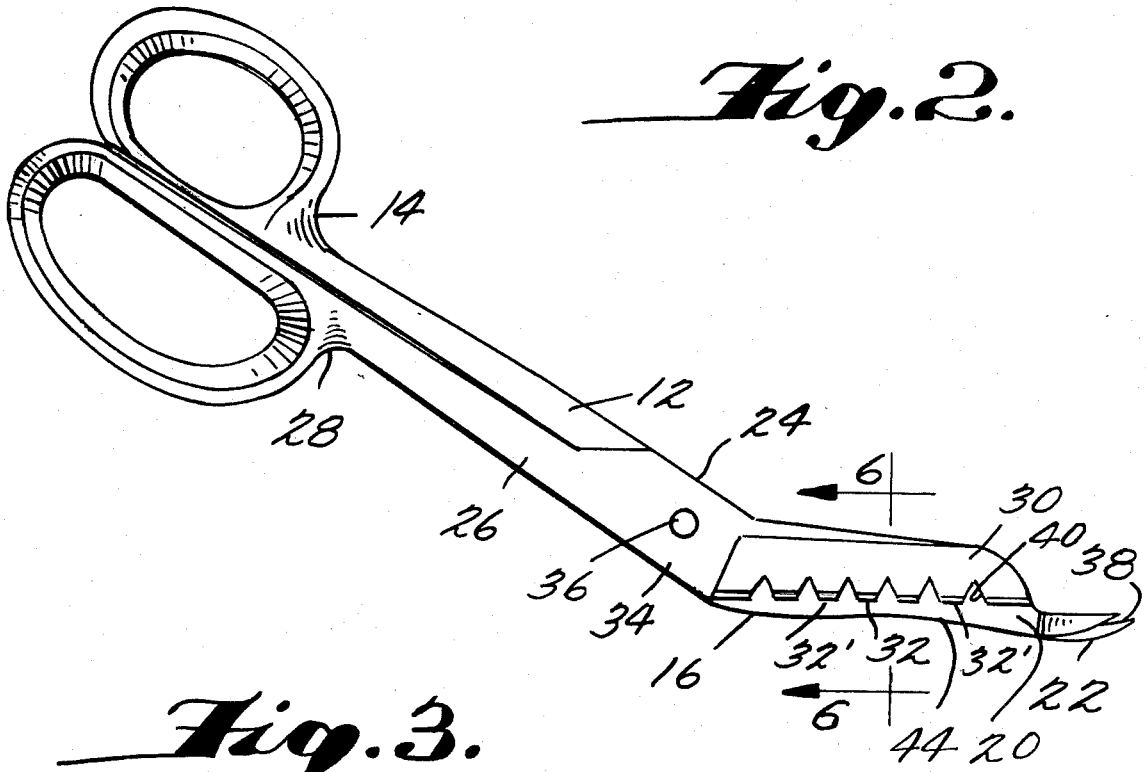
FIG. 2 is a side elevation view illustrating the implement in a closed position.
Figure 3:
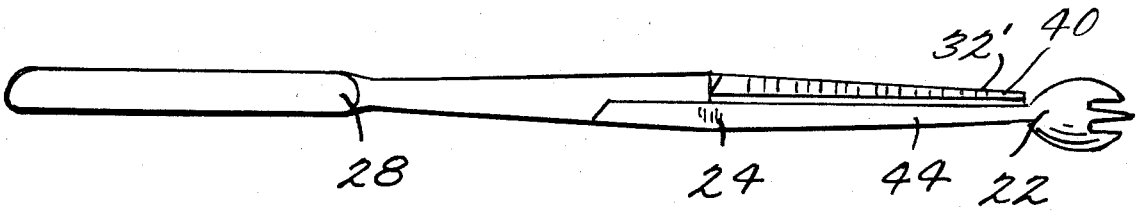
FIG. 3 is a bottom plan view of the implement in a closed position.
Figure 4:
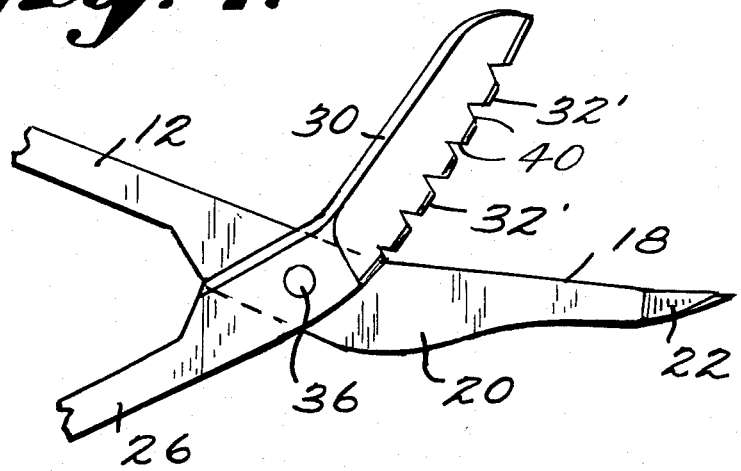
FIG. 4 is a fragmentary side elevation view of the implement in an open position.
Figure 5:
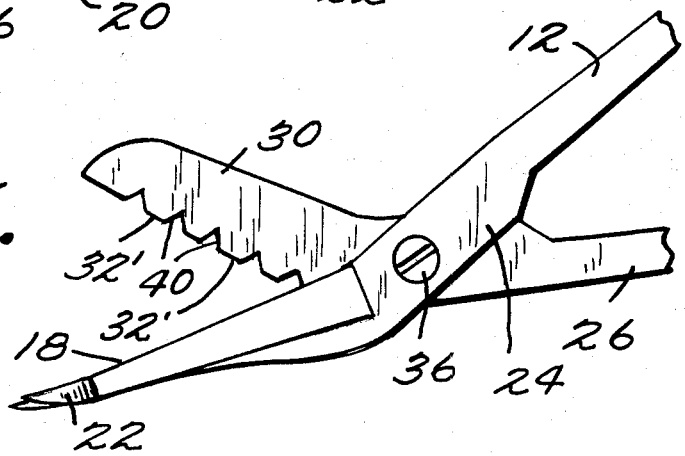
FIG. 5 is a side elevation view of the implement in an open position and viewed from the side opposite that of FIG. 4.
Figure 6:
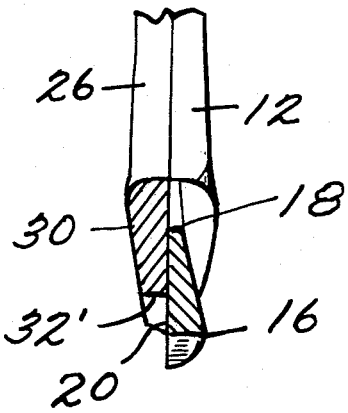
FIG. 6 is a fragmentary sectional view of the implement taken along the line 6—6 of FIG. 2 and looking in the direction of the arrows.
Figure 7:
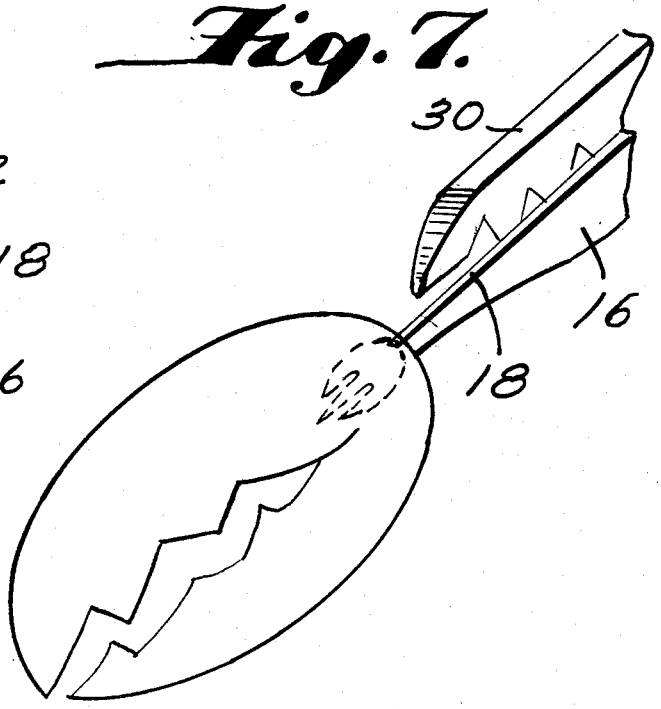
FIG. 7 is a fragmentary perspective view of the implement illustrating the flared, fork-shaped end in use.

With reference now to the drawings, wherein like reference characters designate like or corresponding parts throughout the several views, there is shown a shellfish cutting and eating implement 10 in accordance with this invention. A first lever member 12 includes a first elongated handle portion 14 and a first elongated jaw portion 16. Jaw portion 16 defines a first continuous cutting edge 18, a first substantially flat side surface 20 and a flared end 22. A first intermediate portion 24 is located between and connects together handle portion 14 and jaw portion 16.

A second lever member 26 includes a second elongated handle portion 28 and a second elongated jaw portion 30 defining a second notched cutting edge 32. A second intermediate portion 34 is located between and connects together second handle portion 28 and second jaw portion 30.

A pin or other conventional connecting means 36 is positioned in operative relationship with intermediate portions 24, 34 for pivotally connecting together lever members 12, 26.

In order to help keep first jaw portion 16 in the proper position during the cutting operation, flared end 22 is substantially flat and is positioned substantially perpendicular to side surface 20. Flared end 22 defines at least one pointed forward end 38, but end 22 is preferably in the shape of a fork having three tines 42.

Notches 40 in jaw portion 30 are preferably substantially V-shaped and are substantially evenly spaced along cutting edge 32 to form a plurality of cutting edge portions 32' separated by the notches. Although this invention contemplates configurations of different lengths for cutting edge portions 32' and the spaces created by notches 40, the preferred embodiment of the invention provides for the total length of cutting edge portions 32' to be substantially equal to the total length of the spaces between cutting edge portions 32' created by notches 40. This configuration provides the optimum combination of cutting and crushing forces necessary for cutting through the hard shells of lobsters and crabs.

Because first jaw portion 16 is frequently inserted beneath the shell to be cut, it is preferred that the forward end of the first jaw 16 be narrow in shape. To this end, first jaw portion 16 defines a lower concave surface 44 which has the effect of narrowing the thickness of the forward end of jaw portion 16.

Implement 10 is preferably made from carbonated steel. This material is readily cleaned and provides strength and rust-free durability. Any other comparable strong and rust-free material could be used.

The ends of handle portions 14, 28 are preferably similar to the handles of ordinary scissors. These handles are designed to enable use by left-handed and right-handed persons.

In use, implement 10 cuts into or across the shell of the shellfish in a scissor-like fashion. Cutting edges 18, 32, 32' are designed to crush and cut the hard shells of lobsters and crabs in an optimum fashion. Flared end 22 is shaped and positioned to prevent cutting into the meat as the shell is being cut. The fork shape of flared end 22 also enables the implement to be used to remove the meat from the shell, and the fork-shaped flared end can be used in the same manner as a conventional table fork to eat the meat.

The invention in its broader aspects is not limited to the specific details shown and described, and departures may be made from such details without departing from the principles of the invention and without sacrificing its chief advantages.

What is claimed is:

1. A shellfish cutting and eating implement comprising:

a first lever member including a first elongated handle portion, a first elongated jaw portion defining a first cutting edge a first substantially flat side surface and a flared end, and a first intermediate portion between said handle portion and said jaw portion;

a second lever member including a second elongated handle portion, a second elongated jaw portion defining a second notched cutting edge,and a second intermediate portion between said second handle portion and said second jaw portion: and means in operative relationship with said first and second intermediate portions for pivotally connecting together said first and second lever members to enable said first and second cutting edges to be selectively moved in shearing relationship with each other;

said flared end being substantially flat and substantially perpendicular to said first flat side surface and defining a pointed forward end.

2. An implement as in claim 1 wherein said first cutting edge is continuous.

3. An implement as in claim 2 wherein said notches in said second jaw portion are V-shaped and substantially evenly spaced along said second cutting edge to create a plurality of cutting edge portions separated said notches.

4. An implement as in claim 3 wherein the total length of said second cutting edge portions is substantially equal to the total length of spaces between said cutting edge portions formed bysaid notches.

5. An implement as in claim 3 wherein said flared end is in the shape of a fork.

6. An implement as in claim 5 wherein said fork defines three pointed tines.

7. An implement as in claim 3 wherein said first jaw portion defines a lower concave surface at the forward end thereof

8. An implement as in claim 3 which is comprised of carbonated steel.

* * * * *

UNITED STATES PATENT AND TRADEMARK OFFICE

CERTIFICATE OF CORRECTION

PATENT NO. : 4,519,136

DATED : May 28,1985

INVENTOR(S) : Ernest D. Walker

It is certified that error appears in the above-identified patent and that said Letters Patent are hereby corrected as shown below:

Claim 3, line 4, between "separated" and "said" insert --by--.

Signed and Sealed this

*Seventeenth* Day of *September 1985*

[SEAL]

*Attest:*

DONALD J. QUIGG

*Attesting Officer*

*Commissioner of Patents and Trademarks—Designate*